US008081784B2

(12) United States Patent
Liou et al.

(10) Patent No.: US 8,081,784 B2
(45) Date of Patent: Dec. 20, 2011

(54) ELECTROSTATIC ELECTROACOUSTIC TRANSDUCERS

(75) Inventors: Chang-Ho Liou, Shetou Township (TW); Ming-Daw Chen, Hsinchu (TW); Dar-Ming Chiang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 1141 days.

(21) Appl. No.: 11/849,645

(22) Filed: Sep. 4, 2007

(65) Prior Publication Data

US 2009/0060233 A1 Mar. 5, 2009

(51) Int. Cl.
*H04R 25/00* (2006.01)

(52) U.S. Cl. ..... 381/191; 340/384.73

(58) Field of Classification Search ..... 381/191
See application file for complete search history.

(56) References Cited

U.S. PATENT DOCUMENTS 3,118,022 A * 1/1964 Sessler et al. ..... 381/191

* cited by examiner

*Primary Examiner* — Charles Garber
*Assistant Examiner* — Yasser Abdelaziez
(74) *Attorney, Agent, or Firm* — Alston & Bird LLP

(57) ABSTRACT

An electrostatic electroacoustic device comprising a first electrode configured to receive an audio signal, a first conductive film configured to receive the audio signal, a first electret between the first electrode and the first conductive film, the first electret being capable of vibratory motion relative to the first electrode based on the audio signal, a second electrode configured to receive the audio signal, a second conductive film configured to receive the audio signal, the second conductive film being electrically isolated from the first conductive film, and a second electret between the second electrode and the second conductive film, the second electret being capable of vibratory motion relative to the second electrode based on the audio signal.

30 Claims, 6 Drawing Sheets

ELECTROSTATIC ELECTROACOUSTIC TRANSDUCERS

BACKGROUND OF THE INVENTION

This application generally relates to an acoustic device and, more particularly, to an electrostatic electroacoustic transducer.

With the increasing interest in compact, light-weight and low-profile electronics, many products, such as computer, communication and consumer electronic products, may be manufactured with miniature feature sizes. Down-sized electronic products or components may provide flexibility in various applications. For example, electroacoustic transducers, which may be divided into dynamic-type and electrostatic-type transducers, if properly reduced in dimensions, may facilitate their use in a relatively large device such as a loudspeaker or in a relatively small device such as a microspeaker or earphone. Conventional electroacoustic transducers, however, may have a relatively large size as compared to their acoustic performance. Generally, a dynamic transducer that may serve as a micro speaker in a cell phone may have a thickness of approximately 3 millimeters (mm) or above and a diameter of approximately 12 mm, with a sound pressure level of approximately 80 dB measured at a distance of 10 centimeters (cm) (hereinafter denoted as 80 dB/10 cm). Furthermore, a dynamic loudspeaker may have a thickness of approximately 5 cm or above and a diameter of approximately 12.5 cm with a required sound pressure level of 85 dB/1 meter (m). Moreover, an electrostatic transducer, to satisfy the required sound pressure level of 85 dB/1 m, may be as large as two A4-size papers with a thickness more than approximately 2 cm.

Some conventional electrostatic transducers may include an electrically conductive film between two rigid electrode plates. In operation, a direct-current (DC) bias up to hundreds of volts or above may be applied to the electrically conductive film. Such conventional electrostatic transducers may often require a power amplifier, which may be costly and bulky.

BRIEF SUMMARY OF THE INVENTION

Examples of the present invention may provide an electrostatic electroacoustic device comprising a first electrode configured to receive an audio signal, a first conductive film configured to receive the audio signal, a first electret between the first electrode and the first conductive film, the first electret being capable of vibratory motion relative to the first electrode based on the audio signal, a second electrode configured to receive the audio signal, a second conductive film configured to receive the audio signal, the second conductive film being electrically isolated from the first conductive film, and a second electret between the second electrode and the second conductive film, the second electret being capable of vibratory motion relative to the second electrode based on the audio signal.

Some examples of the present invention may also provide an electrostatic electroacoustic device comprising a first electrode, a second electrode, an electret assembly between the first electrode and the second electrode, the electret assembly comprising a first electret exhibiting a first electrical polarity, a second electret exhibiting a second electrical polarity, the second electrical polarity being different from the first electrical polarity, a first conductive film related to the first electret, and a second conductive film related to the second electret, the second conductive film being electrically isolated from the first conductive film, a first spacer between the electret assembly and the first electrode, and a second spacer between the electret assembly and the second electrode, wherein the electret assembly being capable of vibratory motion relative to the first electrode and the second electrode based on an audio signal applied to the first electrode, the second electrode, the first conductive film and the second conductive film.

Examples of the present invention may further provide an electrostatic electroacoustic device comprising a plurality of acoustic units arranged in a stack, each of the acoustic units comprising a first electrode configured to receive an audio signal, a first conductive film configured to receive the audio signal, a first electret between the first electrode and the first conductive film, the first electret exhibiting a first electrical polarity, a second electrode configured to receive the audio signal, a second conductive film configured to receive the audio signal, the second conductive film being electrically isolated from the first conductive film, and a second electret between the second electrode and the second conductive film, the second electret exhibiting a second electrical polarity, wherein the first electret and the second electret are capable of vibratory motion relative to the first electrode and the second electrode in substantially the same direction based on the audio signal.

Although the present invention has been described with reference to specific example embodiments, it is evident that various modifications and changes may be made to these embodiments without departing from the broader spirit and scope of the invention. Accordingly, the specification and drawings are to be regarded in an illustrative rather than a restrictive sense.

BRIEF DESCRIPTION OF THE SEVERAL VIEWS OF THE DRAWINGS

The foregoing summary, as well as the following detailed description of the invention, will be better understood when read in conjunction with the appended, exemplary drawings. It should be understood, however, that the invention is not limited to the precise arrangements and instrumentalities shown.

In the drawings.

DETAILED DESCRIPTION OF THE INVENTION

Reference will now be made in detail to the present examples of the invention illustrated in the accompanying drawings. Wherever possible, the same reference numbers will be used throughout the drawings to refer to the same or like portions.

Figure 1A:
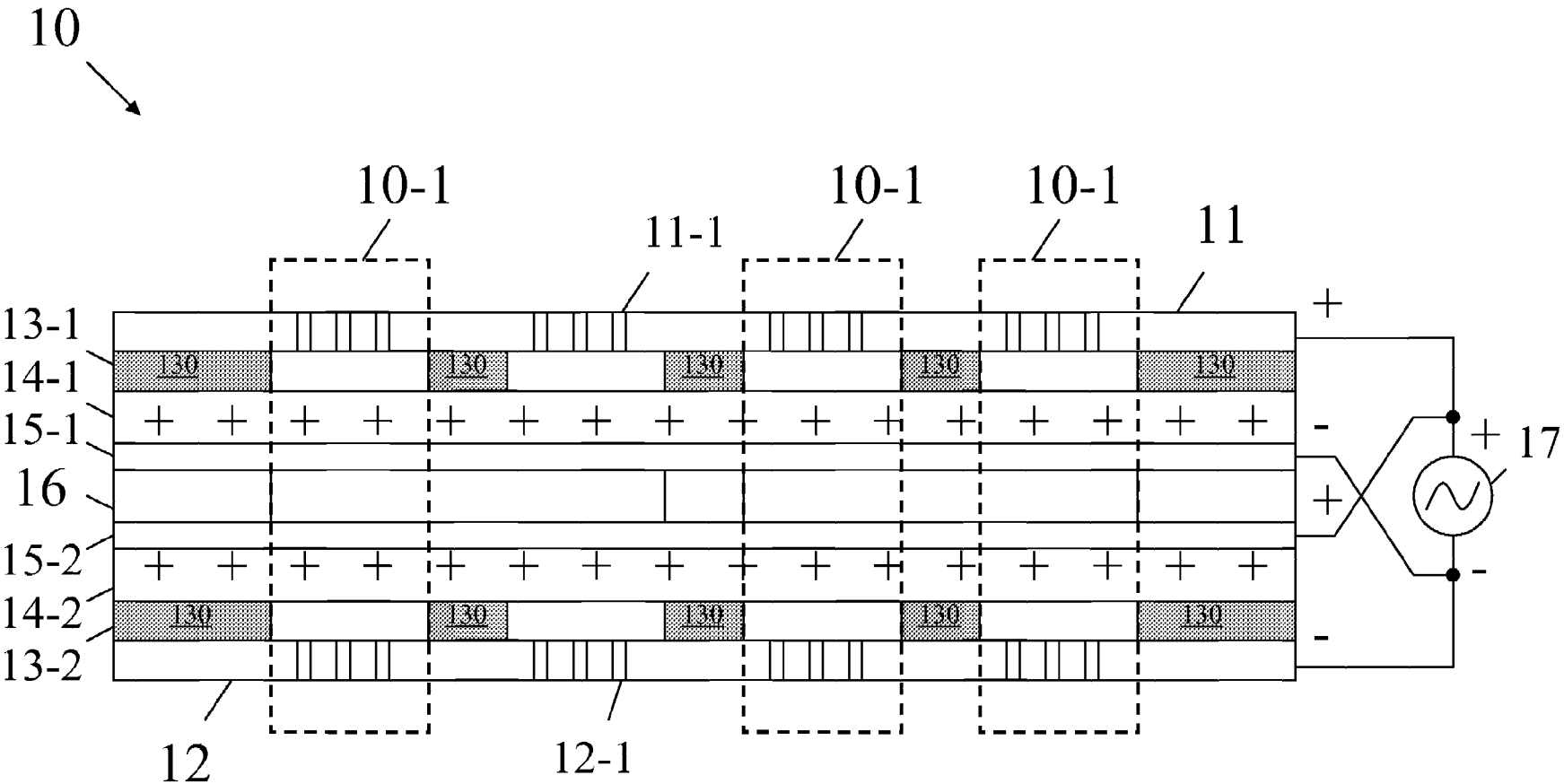
FIG. 1A is a schematic cross-sectional diagram of an electrostatic electroacoustic device in accordance with an example of the present invention.

FIG. 1A is a schematic cross-sectional diagram of an electrostatic electroacoustic device 10 in accordance with an example of the present invention. The electrostatic electroacoustic device 10 may include but is not limited to an electroacoustic transducer capable of converting between an acoustic signal and an audio signal. Referring to FIG. 1A, the electrostatic electroacoustic device 10 may include a first electrode 11, a second electrode 12 and an electret assembly between the first electrode 11 and the second electrode 12. The electret assembly may include a first electret 14-1, a first conductive film 15-1 related to the first electret 14-1, a second electret 14-2 and a second conductive film 15-2 related to the second electret 14-2. An insulating layer 16 may be provided to electrically isolate the first conductive film 15-1 and the second conductive film 15-2. The insulating layer 16 may be a patterned layer as illustrated in FIG. 1A or include a film (not shown) between the first conductive film 15-1 and the second conductive film 15-2. The insulating layer 16 may be required when the first electret 14-1 and the second electret 14-2 exhibit the same electrical polarity. In other examples, however, the insulating layer 16 may be eliminated when the first electret 14-1 and the second electret 14-2 exhibit different electrical polarities. The electrostatic electroacoustic device 10 may further include a first spacer 13-1 between the first electrode 11 and the first electret 14-1, and a second spacer 13-2 between the second electrode 12 and the second electret 14-2.

Each of the first electrode 11 and the second electrode 12 may include one of a conductive metal plate and a polymer plate on which an electrically conductive layer is provided. In various examples according to the present invention, each of the first electrode 11 and the second electrode 12 may be optically transparent and may include a material selected from one of polyimide (PI), polycarbonate (PC), polyethylene terephthalate (PET), polymethyl methacrylate (PMMA), cyclic olefin copolymer (COC) and a suitable photoelectric material. In other examples, each of the first electrode 11 and the second electrode 12 may be flexible and may include one of a conductive metal film or net, a conductive fiber and a polymeric substrate on which a conductive film is provided. The conductive fiber, which may take the form of a sheet, net or felt, may include but is not limited to one or more of a metal fiber, a carbon fiber, a graphite fiber or a non-conductive fiber such as a glass fiber coated with metal, carbon or graphite. The polymeric substrate may include one of PI, PC, PET, PMMA and COC, while the conductive film coated on the polymeric substrate may include one of indium tin oxide (ITO) and indium zinc oxide (IZO).

Each of the first electrode 11 and the second electrode 12 may have a thickness of approximately 10 to 3000 micrometers (μm). The first electrode 11 may include a number of holes 11-1, which may serve as acoustic passages. Likewise, the second electrode 12 may include a number of holes 12-1 to serve as acoustic passages. In various examples, the ratio of the holes 11-1 to the first electrode 11 in area may range from approximately 5% to 70%. Methods for forming the holes 11-1 and 12-1 may include but are not limited to a patterning and etching process, a laser radiation process or a suitable mechanical process.

The first conductive film 15-1 and the second conductive film 15-2 may serve as an electrode for the first electret 14-1 and the second electret 14-2, respectively. Specifically, the first conductive film 15-1 and the first electrode 11 function to serve as a pair of electrodes for the first electret 14-1, and the second conductive film 15-2 and the second electrode 12 function to serve as a pair of electrodes for the second electret 14-2. Each of the first conductive film 15-1 and the second conductive film 15-2 may include but is not limited to a metal film, such as an aluminum film, and an ITO or IZO film. Methods for forming the conductive film 15-3 may include one of evaporation, sputtering and spin coating. In various examples, each of the first conductive film 15-1 and the second conductive film 15-2 may have a thickness ranging from approximately 0.01 to 3 μm.

An electret may refer to a dielectric that is able to produce a permanent external electric field which results from permanent ordering of molecular dipoles or from stable uncompensated surface or space charge. In various examples according to the present invention, each of the first electret 14-1 and the second electret 14-2 may include one or more dielectric film selected from one of polyterafluoroethylene (PTFE), fluorinated ethylene propylene (FEP), amorphous fluoropolymer (AF), polyvinylidene difluoride (PVDF), COC and a transparent polymer containing fluorine (F). The dielectric film may be meso-porous or nano-porous, and may be "electrized" by, for example, corona charging, to permanently maintain electrostatic charges. Specifically, each of the first electret 14-1 and the second electret 14-2 may be positively charged with electric holes or negatively charged with electrons. In the present example, the first electret 14-1 and the second electret 14-2 may have the same sign of charge and exhibit the same electrical polarity, i.e., positive electrical polarity. The electret assembly in one example may have a thickness of approximately 1 to 1000 μm.

The first spacer 13-1 and the second spacer 13-2 may provide a predetermined distance to allow vibratory motion of the electret assembly between the first electrode 11 and the second electrode 12. Each of the first spacer 13-1 and the second spacer 13-2 may include a number of spacer units 130, which may be arranged at places not to interfere with the acoustic passages 11-1 and 12-1. Furthermore, a number of acoustic regions 10-1 may be defined by the spacer units 130 and the acoustic passages 11-1 and 11-2. In various examples, each of the first spacer 13-1 and the second spacer 13-2 may have a thickness ranging from approximately 2 to 1000 μm. Suitable materials for the spacers 13-1 and 13-2 may include but are not limited to PI, PC, PET, PMMA or COC. Based on selection of materials, various examples of the electrostatic electroacoustic device 10 may exhibit features of transparency, flexibility or both. These features may facilitate the electroacoustic device's outlook design and its configuration or assembly with other electronic products. The spacers 13-1 and 13-2 may include a pattern formed by, for example, a patterning and etching process. Such a pattern may be configured to support an electrode such as the first electrode 11, and allow passage for sound waves. Similarly, the insulating layer 16 may be designed with a pattern to allow passage for sound waves.

Figure 1B:
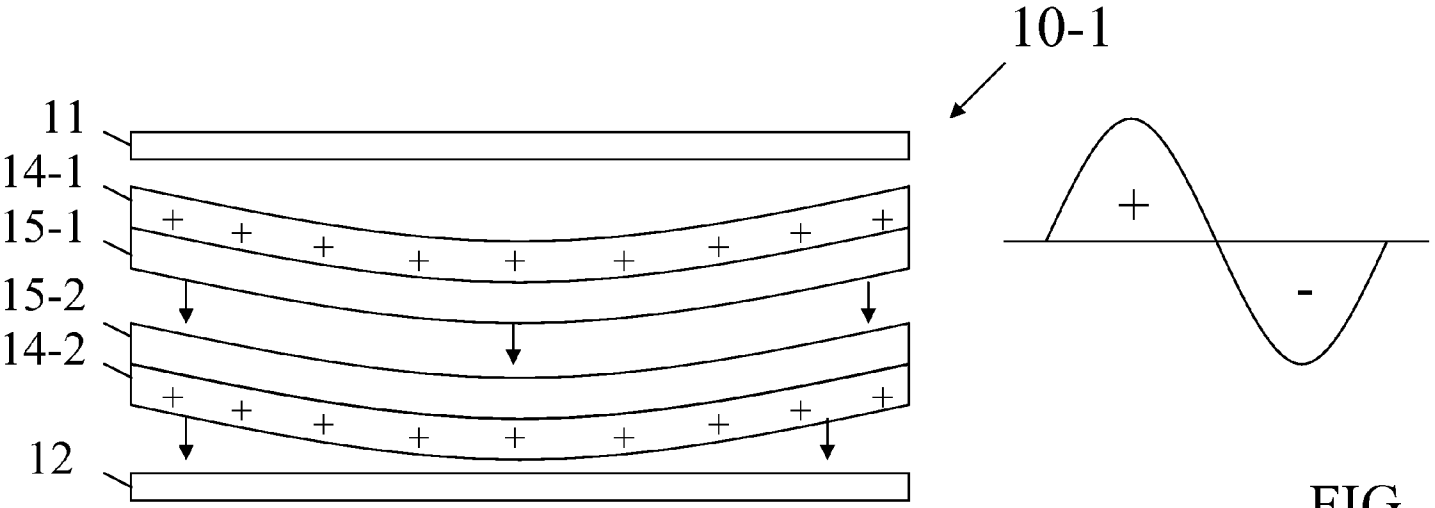
FIGS. 1B and 1C are schematic diagrams illustrating the operation of the electrostatic electroacoustic device in an acoustic region illustrated in FIG. 1A.
Figure 1C:
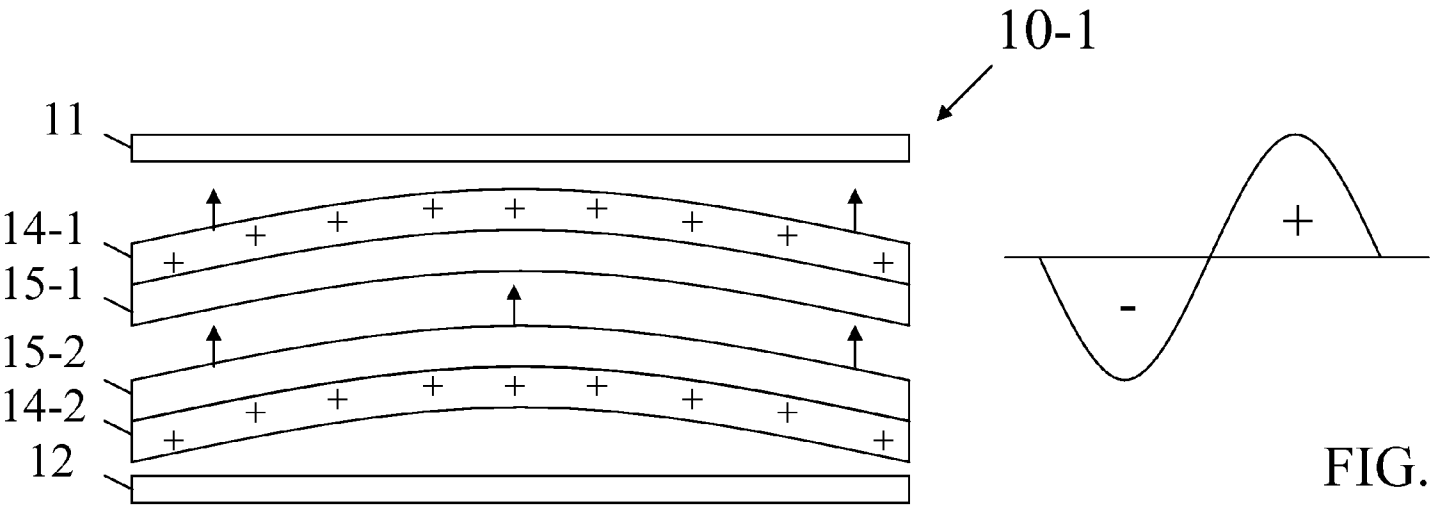

FIGS. 1B and 1C are schematic diagrams illustrating, according to an example, the operation of the electrostatic electroacoustic device 10 in one of the acoustic regions 10-1 illustrated in FIG. 1A. Referring to FIGS. 1A and 1B, the first electrode 11 and the second electrode 12 may be coupled to a signal source 17 and receive an audio signal from the signal source 17. The audio signal may include, for example, sound waves in the form of an alternating-current (AC) signal. Referring to FIG. 1B, during a first half cycle of the audio signal, the first electrode 11 may be positively biased, which may repulse the first electret 14-1 together with the first conductive film 15-1 toward the second electrode 12. Meanwhile, the second electrode 12 may be negatively biased, which may attract the second electret 14-2 together with the second conductive film 15-2 toward the second electrode 12. As a result, the electret assembly may move relative to the first electrode 11 toward the second electrode 12.

Referring to FIGS. 1A and 1C, during a second half cycle, the first electrode 11 may be negatively biased, which may attract the first electret 14-1 together with the first conductive film 15-1 toward the first electrode 11. Meanwhile, the second electrode 12 may be positively biased, which may repulse the second electret 14-2 together with the second conductive film 15-2 toward the first electrode 11. As a result, the electret assembly may move relative to the second electrode 12 toward the first electrode 11. Without intending to be limited to any particular theory, the strength of the electrostatic attraction or repulsion between the electret assembly and the first electrode 11 or the second electrode 12 may be determined by Coulomb's law given below.

$$F=k\times V_1\times V_2\times A/d^2$$

Where "F" is the force of attraction or repulsion, $V_1$ is the electric potential of an electret assembly, which may depend on the amount of charge, $V_2$ is a voltage level of a signal source applied to electrodes, "d" is the distance between the electret assembly and one of the electrodes, and "k" is a constant, which may depend on the material of the electret assembly.

Figure 2:
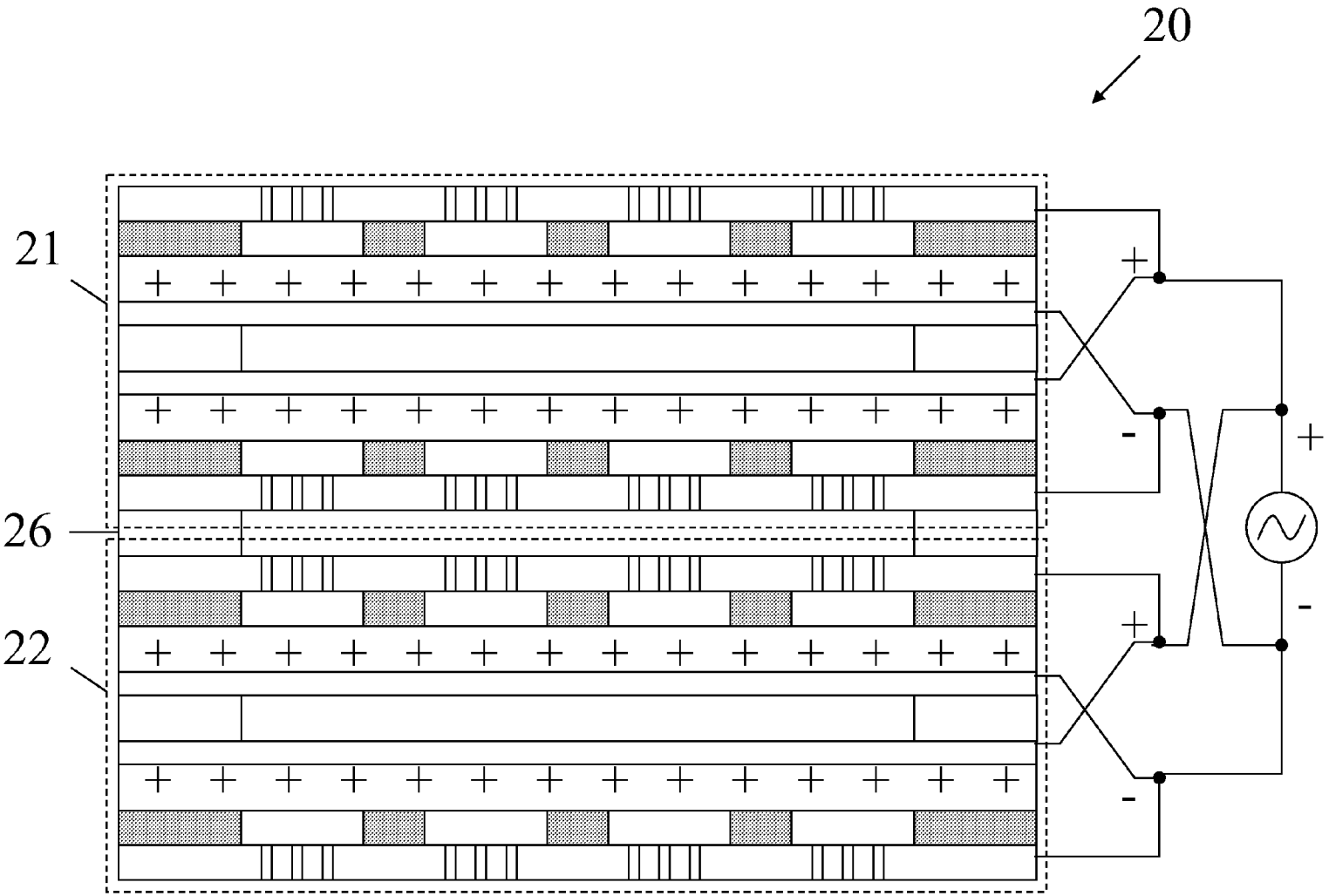
FIG. 2 is a schematic cross-sectional diagram of an electrostatic electroacoustic device in accordance with another example of the present invention.

FIG. 2 is a schematic cross-sectional diagram of an electrostatic electroacoustic device 20 in accordance with another example of the present invention. Referring to FIG. 2, the electrostatic electroacoustic device 20 may include a first acoustic unit 21 and a second acoustic unit 22, which may be electrically isolated from one another by an insulating layer 26. The insulating layer 26 may be a patterned layer as illustrated in FIG. 2 or include a film (not shown) between the first acoustic unit 21 and the second acoustic unit 22. Each of the first acoustic unit 21 and the second acoustic unit 22 may be similar to the electrostatic electroacoustic device 10 described and illustrated with reference to FIG. 1A. By superposing the first acoustic unit 21 on the second acoustic unit 22, the sound pressure level of the electrostatic electroacoustic device 20 may be improved as compared to the electrostatic electroacoustic device 10 illustrated in FIG. 1A that has a single acoustic unit structure. Furthermore, such a stack structure of the electrostatic electroacoustic device 20 may have improved performance in low-frequency audio range. For example, some conventional electroacoustic devices may operate at an audio range from approximately 500 Hertz (Hz) to 15 kilo-Hertz (KHz), while the electrostatic electroacoustic device 20 may operate at an audio range from approximately 20 Hz to 15 KHz, which advantageously expands the low-frequency range between approximately 20 Hz and 500 Hz.

Figure 3A:
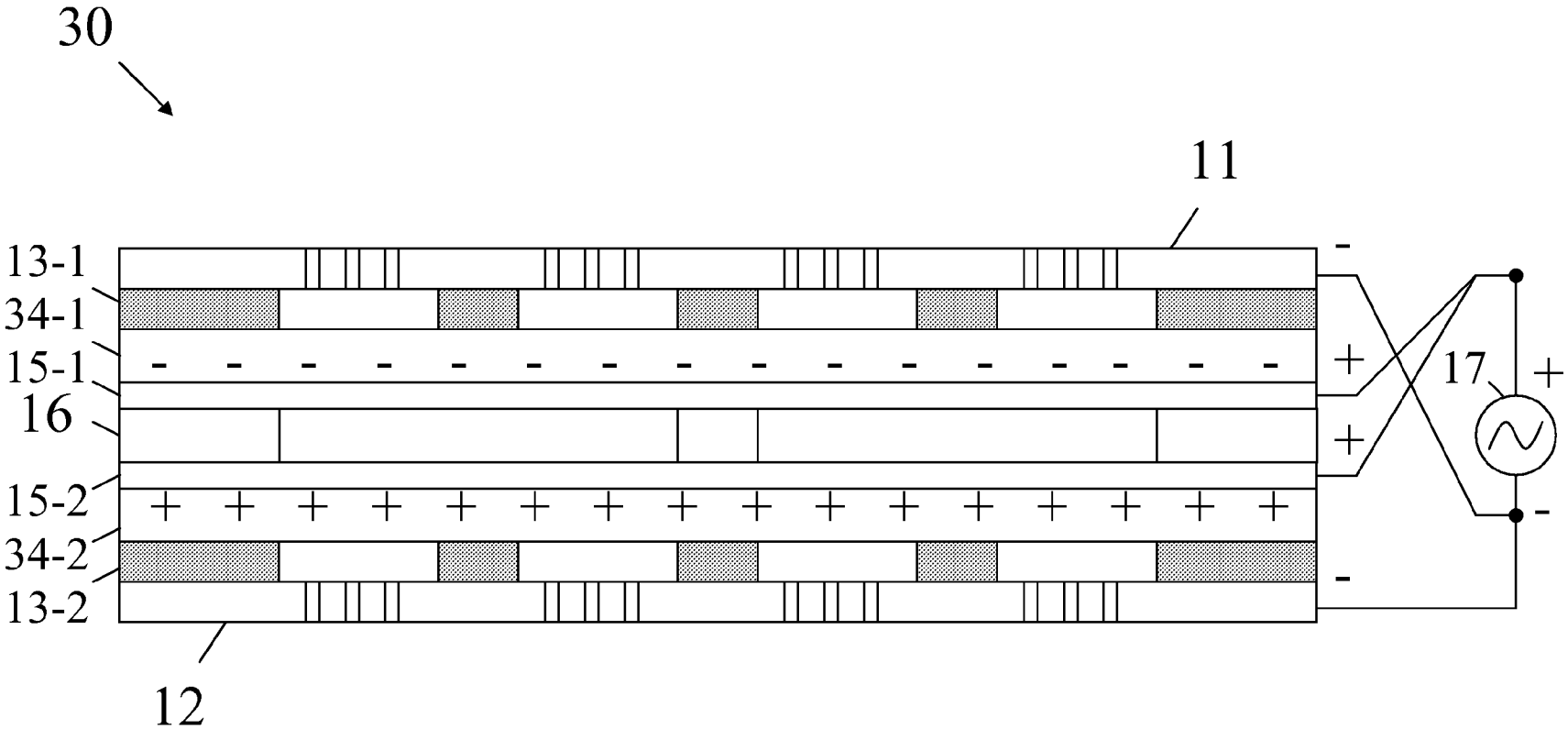
FIG. 3A is a schematic cross-sectional diagram of an electrostatic electroacoustic device in accordance with yet another example of the present invention.

FIG. 3A is a schematic cross-sectional diagram of an electrostatic electroacoustic device 30 in accordance with yet another example of the present invention. Referring to FIG. 3A, the electrostatic electroacoustic device 30 may be similar to the electrostatic electroacoustic device 10 described and illustrated with reference to FIG. 1A except for a first electret 34-1 and a second electret 34-2 in place of the first electret 14-1 and the second electret 14-2, respectively. Specifically, the first electret 34-1 and the second electret 34-2 may have different sign of charge and exhibit different electrical polarities. In the present example, the first electret 34-1 has a negative electrical polarity while the second electret 34-2 has a positive electrical polarity. By appropriately coupling the electrodes 11, 12, 15-1 and 15-2 to the signal source 17 as illustrated in FIG. 3, the electret assembly, which may include the electrets 34-1 and 34-2 and the conductive films 15-1 and 15-2, of the electrostatic electroacoustic device 30 may move relative to the electrodes 11 and 12 in a fashion similar to the movement described and illustrated with reference to FIGS. 1B and 1C.

Figure 3B:
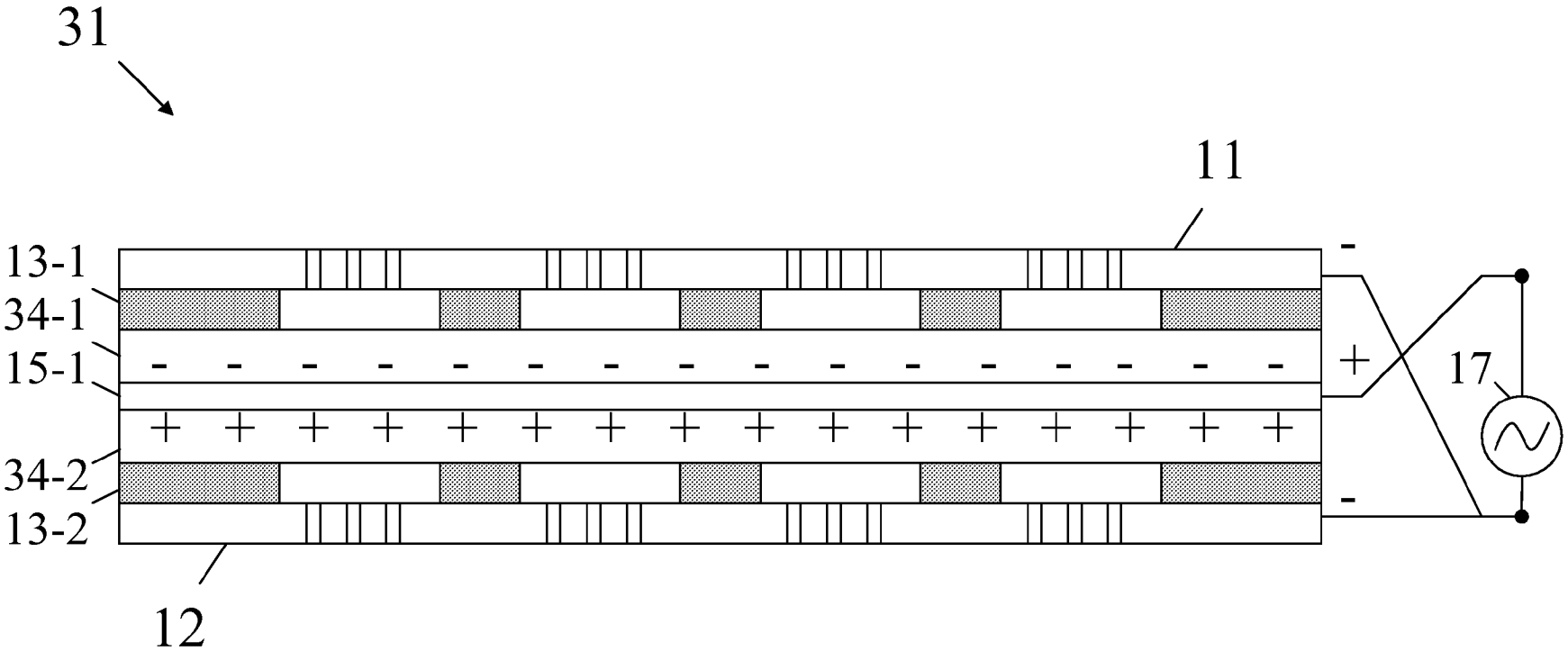
FIG. 3B is a schematic cross-sectional diagram of an electrostatic electroacoustic device in accordance with still another example of the present invention.

FIG. 3B is a schematic cross-sectional diagram of an electrostatic electroacoustic device 31 in accordance with still another example of the present invention. Referring to FIG. 3B, the electrostatic electroacoustic device 31 may be similar to the electrostatic electroacoustic device 30 described and illustrated with reference to FIG. 3A except that, for example, the insulating layer 16 and one of the conductive films such as the second conductive film 15-2 in FIG. 3A are eliminated because the first electret 34-1 and the second electret 34-2 exhibit different electrical polarities.

Figure 4:
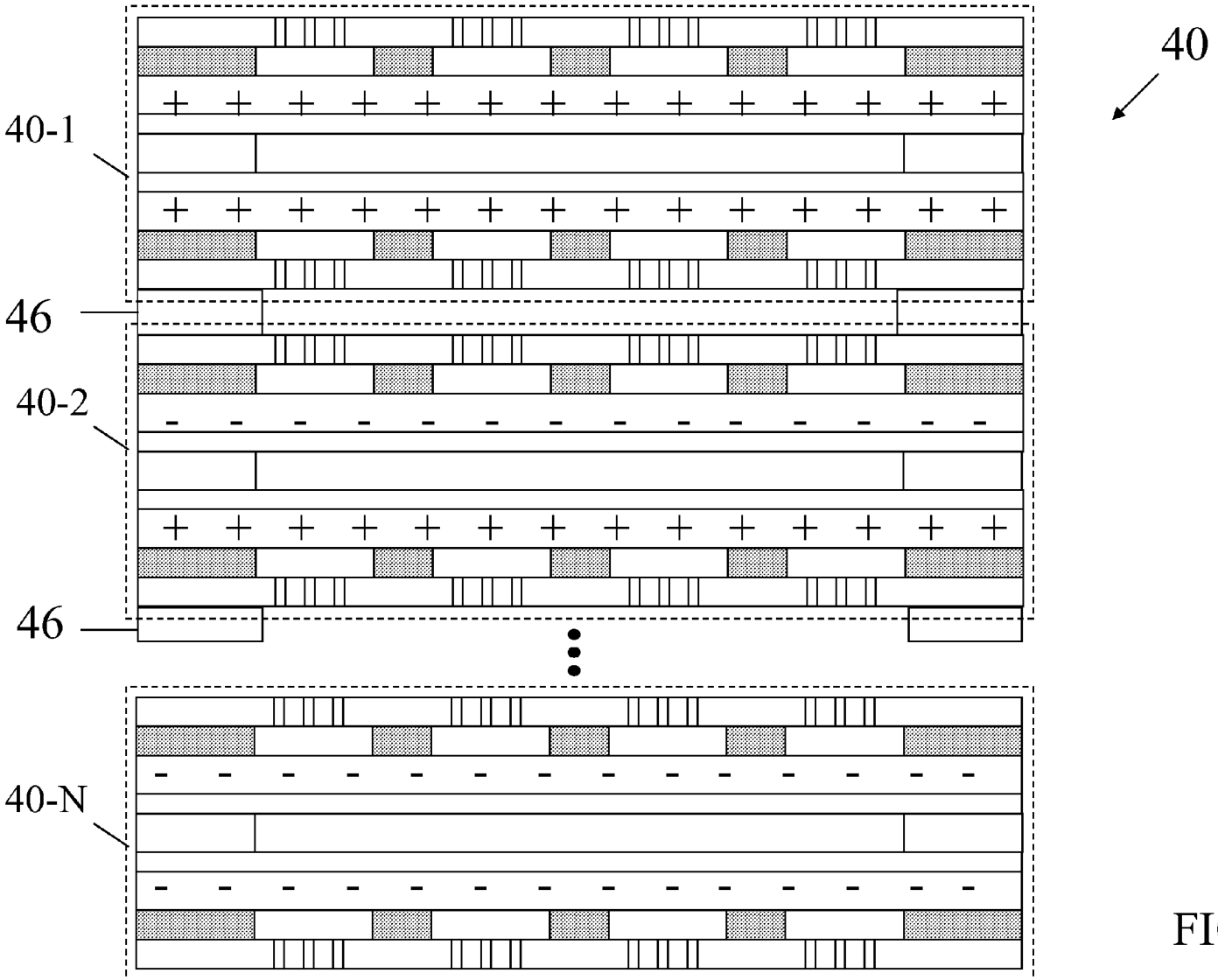
FIG. 4 is a schematic cross-sectional diagram an electrostatic electroacoustic device in accordance with still another example of the present invention.

FIG. 4 is a schematic cross-sectional diagram an electrostatic electroacoustic device 40 in accordance with still another example of the present invention. Referring to FIG. 4, the electrostatic electroacoustic device 40 may include a number of "N" acoustic units 40-1 to 40-N, N being a natural number. The acoustic units 40-1 to 40-N may be arranged in a superposed structure and electrically isolated one from another by insulating layers 46. Each of the acoustic units 40-1 to 40-N may be similar to the electrostatic electroacoustic device 10 described and illustrated with reference to FIG. 1A. However, some acoustic units such as the first acoustic unit 40-1 may include electrets having a positive electrical polarity, and some acoustic units such as the acoustic unit 40-N may include electrets having a negative electrical polarity. Furthermore, other acoustic units such as the second acoustic unit 40-2 may include electrets having different electrical polarity. By appropriate electric connection to a signal source, the electret assembly of each of the acoustic units 40-1 to 40-N may synchronously move in a first direction during a first half cycle and synchronously move in a second direction during a second half cycle in a fashion similar to the movement described and illustrated with reference to FIGS. 1B and 1C.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

It will be appreciated by those skilled in the art that changes could be made to the examples described above without departing from the broad inventive concept thereof. It is understood, therefore, that this invention is not limited to the particular examples disclosed, but it is intended to cover modifications within the spirit and scope of the present invention as defined by the appended claims.

We claim:

1. An electrostatic electroacoustic device comprising:

a first electrode configured to receive an audio signal;

a first conductive film configured to receive the audio signal;

a first electret between the first electrode and the first conductive film, the first electret being capable of vibratory motion relative to the first electrode based on the audio signal;

a second electrode configured to receive the audio signal;

a second conductive film configured to receive the audio signal, the second conductive film being electrically isolated from the first conductive film; and a second electret between the second electrode and the second conductive film, the second electret being capable of vibratory motion relative to the second electrode based on the audio signal.

2. The device of claim 1, wherein one of the first electrode and the second electrode includes a material selected from at least one of polyimide (PI), polycarbonate (PC), polyethylene terephthalate (PET), polymethyl methacrylate (PMMA) and cyclic olefin copolymer (COC).

3. The device of claim 1, wherein one of the first electrode and the second electrode includes one of a polymeric substrate, a conductive metal film, a conductive fiber, and a polymeric substrate on which a conductive film is provided.

4. The device of claim 3, wherein the conductive fiber includes at least one of a metal fiber, a carbon fiber, a graphite fiber, or a glass fiber coated with metal, carbon or graphite.

5. The device of claim 3, wherein the polymeric substrate includes one of PI, PC, PET, PMMA and COC, and the conductive layer provided on the polymeric substrate includes one of indium tin oxide (ITO) and indium zinc oxide (IZO).

6. The device of claim 1, wherein one of the first electret and the second electret includes at least one dielectric layer, the at least one dielectric layer including a material selected from at least one of polyterafluoroethylene (PTFE), fluorinated ethylene propylene (FEP), amorphous fluoropolymer (AF), COC and a transparent polymer containing fluorine (F).

7. The device of claim 1, wherein one of the first conductive film and the second conductive film includes one of an aluminum film, ITO film and IZO film.

8. The device of claim 1 further comprising a first spacer between the first electrode and the first electret, and a second spacer between the second electrode and the second electret.

9. The device of claim 8, wherein one of the first spacer and the second spacer includes one of PI, PC, PET, PMMA and COC.

10. The device of claim 1, wherein the first electret and the second electret exhibit the same electrical polarity.

11. The device of claim 1, wherein the first electret and the second electret exhibit opposed electrical polarity.

12. An electrostatic electroacoustic device comprising:

a first electrode;

a second electrode;

an electret assembly between the first electrode and the second electrode, the electret assembly comprising:

a first electret exhibiting a first electrical polarity;

a second electret exhibiting a second electrical polarity, the second electrical polarity being different from the first electrical polarity;

a first conductive film related to the first electret; and a second conductive film related to the second electret, the second conductive film being electrically isolated from the first conductive film;

a first spacer between the electret assembly and the first electrode; and a second spacer between the electret assembly and the second electrode, wherein the electret assembly being capable of vibratory motion relative to the first electrode and the second electrode based on an audio signal applied to the first electrode, the second electrode, the first conductive film and the second conductive film.

13. The device of claim 12, wherein one of the first electrode and the second electrode includes a material selected from at least one of polyimide (PI), polycarbonate (PC), polyethylene terephthalate (PET), polymethyl methacrylate (PMMA) and cyclic olefin copolymer (COC).

14. The device of claim 12, wherein one of the first electrode and the second electrode includes one of a conductive metal film, a conductive fiber, and a polymeric substrate on which a conductive layer is provided.

15. The device of claim 14, wherein the conductive fiber includes at least one of a metal fiber, a carbon fiber, a graphite fiber, or a glass fiber coated with metal, carbon or graphite.

16. The device of claim 14, wherein the polymeric substrate includes one of PI, PC, PET, PMMA and COC, and the conductive layer provided on the polymeric substrate includes one of indium tin oxide (ITO) and indium zinc oxide (IZO).

17. The device of claim 12, wherein one of the first electret and the second electret includes at least one dielectric layer, the at least one dielectric layer including a material selected from at least one of polyterafluoroethylene (PTFE), fluorinated ethylene propylene (FEP), amorphous fluoropolymer (AF), COC and a transparent polymer containing fluorine (F).

18. The device of claim 12, wherein one of the first conductive film and the second conductive film includes one of an aluminum film, ITO film and IZO film.

19. The device of claim 12, wherein one of the first spacer and the second spacer includes one of PI, PC, PET, PMMA and COC.

20. An electrostatic electroacoustic device comprising:

a plurality of acoustic units arranged in a stack, each of the acoustic units comprising:

a first electrode configured to receive an audio signal;

a first conductive film configured to receive the audio signal;

a first electret between the first electrode and the first conductive film, the first electret exhibiting a first electrical polarity;

a second electrode configured to receive the audio signal;

a second conductive film configured to receive the audio signal, the second conductive film being electrically isolated from the first conductive film; and a second electret between the second electrode and the second conductive film, the second electret exhibiting a second electrical polarity, wherein the first electret and the second electret are capable of vibratory motion relative to the first electrode and the second electrode in substantially the same direction based on the audio signal.

21. The device of claim 20, wherein one of the first electrode and the second electrode includes a material selected from at least one of polyimide (PI), polycarbonate (PC), polyethylene terephthalate (PET), polymethyl methacrylate (PMMA) and cyclic olefin copolymer (COC).

22. The device of claim 20, wherein one of the first electrode and the second electrode includes one of a conductive metal film, a conductive fiber, and a polymeric substrate on which a conductive film is provided.

23. The device of claim 22, wherein the conductive fiber includes at least one of a metal fiber, a carbon fiber, a graphite fiber, or a glass fiber coated with metal, carbon or graphite.

24. The device of claim 22, wherein the polymeric substrate includes one of PI, PC, PET, PMMA and COC, and the conductive film coated on the polymeric substrate includes one of indium tin oxide (ITO) and indium zinc oxide (IZO).

25. The device of claim 20, wherein one of the first electret and the second electret includes at least one dielectric layer, the at least one dielectric layer including a material selected from at least one of polyterafluoroethylene (PTFE), fluorinated ethylene propylene (FEP), amorphous fluoropolymer (AF), COC and a transparent polymer containing fluorine (F).

26. The device of claim 20, wherein one of the first conductive film and the second conductive film includes one of an aluminum film, ITO film and IZO film.

27. The device of claim 20 further comprising a first spacer between the first electrode and the first electret, and a second spacer between the second electrode and the second electret.

28. The device of claim 27, wherein one of the first spacer and the second spacer includes one of PI, PC, PET, PMMA and COC.

29. The device of claim 27, wherein each of the first spacer and the second spacer includes a pattern.

30. The device of claim 20, wherein one of the first electrical polarity and the second electrical polarity is a positive electrical polarity, and the other of the first electrical polarity and the second electrical polarity is a negative electrical polarity.

* * * * *